US008210764B2

(12) United States Patent
Holowecky

(10) Patent No.: US 8,210,764 B2
(45) Date of Patent: Jul. 3, 2012

(54) DISPOSABLE TOOTHBRUSH

(76) Inventor: Bohdan Holowecky, Philadelphia, PA (US)

( * ) Notice: Subject to any disclaimer, the term of this patent is extended or adjusted under 35 U.S.C. 154(b) by 495 days.

(21) Appl. No.: 12/484,433

(22) Filed: Jun. 15, 2009

(65) Prior Publication Data

US 2010/0043164 A1 Feb. 25, 2010

Related U.S. Application Data

(63) Continuation-in-part of application No. 12/228,986, filed on Aug. 19, 2008.

(51) Int. Cl.
*B43K 5/14* (2006.01)
*A46B 11/04* (2006.01)

(52) U.S. Cl. ..... 401/132; 401/291

(58) Field of Classification Search ..... 401/132–135, 401/268, 291
See application file for complete search history.

(56) References Cited

U.S. PATENT DOCUMENTS

| | | | | | |
|---|---|---|---|---|---|
| 1,811,833 | A * | 6/1931 | Simon | 401/132 |
| 2,550,190 | A * | 4/1951 | Greenberg | 401/183 |
| 3,536,410 | A * | 10/1970 | Wargoe | 401/132 |
| 4,617,694 | A * | 10/1986 | Bori | 401/7 |
| 5,366,310 | A * | 11/1994 | Armelles Flors | 401/132 |
| 5,599,126 | A * | 2/1997 | Hough | 401/184 |
| 5,893,378 | A * | 4/1999 | Llerena | 132/311 |
| 5,915,868 | A * | 6/1999 | Frazell | 401/132 |
| 6,643,886 | B2 * | 11/2003 | Moskovich et al. | 15/167.1 |

* cited by examiner

*Primary Examiner* — David Walczak
*Assistant Examiner* — Bradley Oliver
(74) *Attorney, Agent, or Firm* — James Ray & Assoc

(57) ABSTRACT

A disposable toothbrush includes a handle member produced from a pre-selected biodegradable material. The handle member has a predetermined size and a predetermined shape. There are a predetermined number of rows of bristles attached to and extending above a top surface of the handle member closely adjacent one end thereof. Such bristles have a predetermined length. A pouch containing toothpaste is disposed beneath the rows of bristles such that the toothpaste will be in fluid communication with the bristles when the pouch is punctured and compressed.

12 Claims, 3 Drawing Sheets

DISPOSABLE TOOTHBRUSH

CROSS REFERENCE TO RELATED APPLICATION

This patent application is related to and claims priority from U.S. patent application Ser. No. 12/228,986 filed Aug. 19, 2009.

FIELD OF THE INVENTION

The present invention relates, in general, to dental hygiene and, more particularly, this invention relates to a disposable toothbrush for use in such dental hygiene.

BACKGROUND OF THE INVENTION

Prior to the conception and development of the present invention, as is generally well known in the prior art, dental hygiene is of utmost importance for a number of reasons; however, there are times when because of circumstances where the proper equipment, such as a toothbrush or toothpaste, is not available thereby making proper dental hygiene difficult. It is well established that poor dental hygiene can lead to poor health as well as bad breath.

Because brushing one's teeth is a time consuming task, it is often the case that people who are running late for whatever reason will forego brushing their teeth in order to conserve as much time as possible.

Therefore it would be advantageous if there were a disposable toothbrush and toothpaste available for emergencies.

The applicant is aware of the following U.S. Patents dealing with disposable toothbrushes:

1) U.S. Pat. No. 3,738,762;
2) U.S. Pat. No. 3,917,420;
3) U.S. Pat. No. 4,530,129;
4) U.S. Pat. No. 4,865,481; and
5) U.S. Pat. No. 5,599,126.

SUMMARY OF THE INVENTION

In a first aspect the present invention provides a single use disposable toothbrush. The disposable toothbrush includes a handle member produced from a pre-selected biodegradable material. Such handle member having a predetermined size and a predetermined shape. A predetermined number of rows of bristles are attached to and extend from a first surface of the handle member closely adjacent one end thereof. Such bristles have a predetermined length. A plurality of apertures are formed through such one end of such handle member and intermediate such rows of bristles. Further, there is a pouch containing toothpaste disposed on a radially opposes second side of the handle member and over such apertures. The toothpaste will be in fluid communication with the bristles when the pouch is both punctured and compressed. There is a means disposed intermediate such pouch and such apertures for puncturing such pouch when such pouch is compressed.

In a second embodiment of the invention there is provided a single use disposable toothbrush. Such single use disposable toothbrush comprises a handle member produced from a pre-selected biodegradable material, such handle member having a predetermined size and a predetermined shape. A predetermined number of rows of bristles are attached to and extend from a first surface of the handle member closely adjacent one end thereof, such bristles having a predetermined length. A plurality of apertures are formed through such one end of such handle member and intermediate the rows of bristles. A pouch, containing toothpaste, is disposed on a radially opposed second side of the handle member and over the apertures, such toothpaste being in fluid communication with the bristles when the pouch is punctured and compressed. There is, further, a means disposed on the handle member for puncturing such pouch thereby permitting such toothpaste to flow onto the bristles when the pouch is compressed.

In a third embodiment of the invention there is provided A single use disposable toothbrush, such single use disposable toothbrush comprises a handle member produced from a preselected biodegradable material, such handle having a predetermined size and a predetermined shape. A predetermined number of rows of bristles are attached to and extend from a first surface of the handle member closely adjacent one end thereof, such bristles having a predetermined length. There are a plurality of apertures formed through such one end of the handle member and intermediate the rows of bristles, such plurality of apertures being disposed in a single row substantially in a center of such one end of the handle member. A pouch, containing toothpaste, is disposed on a radially opposed second side of the handle member and over such apertures, the pouch includes a plurality of apertures, such apertures are in fluid communication with corresponding apertures disposed on the one end of such handle member. There is also a means removably engageable with the handle member for covering such apertures on the one end of the handle member so as to prevent such toothpaste from flowing until such means is removed thereby permitting such toothpaste to flow onto the bristles when such pouch is compressed.

OBJECTS OF THE INVENTION

It is, therefore, one of the primary objects of the present invention to provide a disposable toothbrush which is easy to use.

Another object of the present invention is to provide a disposable toothbrush which is relatively inexpensive to manufacture.

Still another object of the present invention is to provide a disposable toothbrush which is environmentally friendly by being produced from biodegradable materials.

Yet another object of the present invention is to provide a disposable toothbrush which is relatively small compared to normal toothbrushes.

An additional object of the present invention is to provide a disposable toothbrush which is has a built in toothpaste holder.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
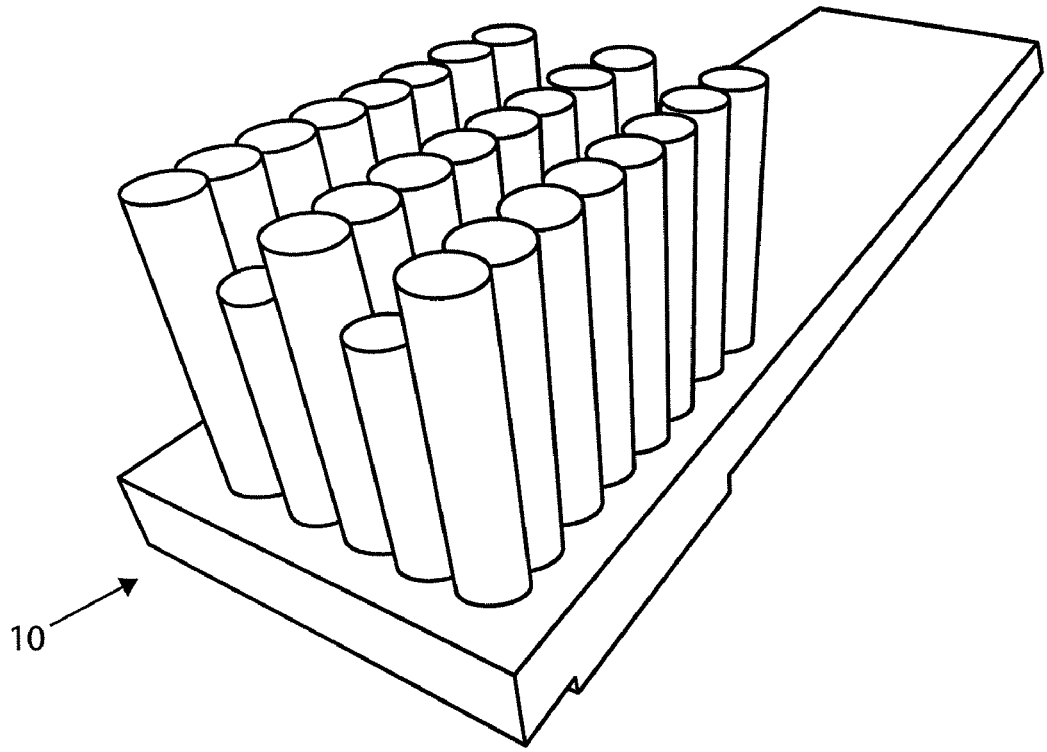
FIG. 1 is a top perspective view of a presently preferred embodiment of the invention.
Figure 2:
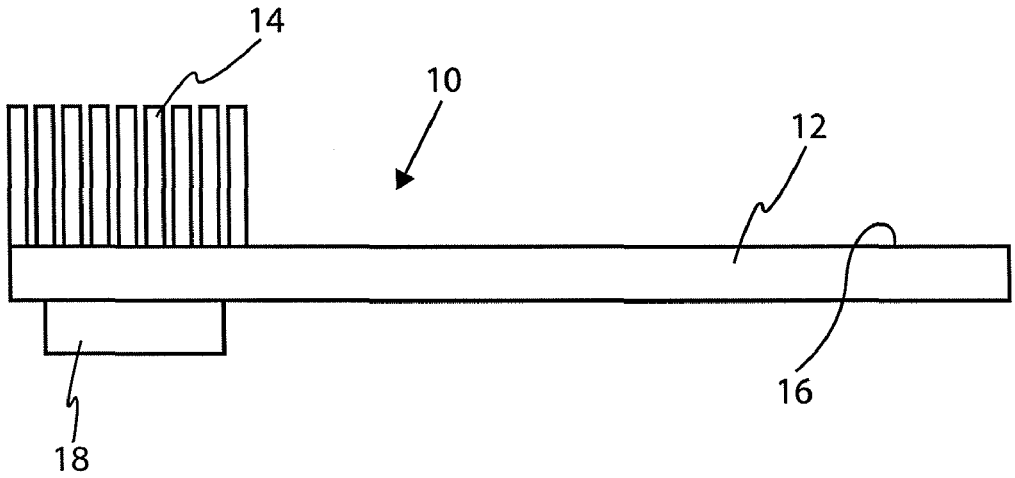
FIG. 2 is a side elevation view of disposable toothbrush illustrated in FIG. 1.
Figure 3:
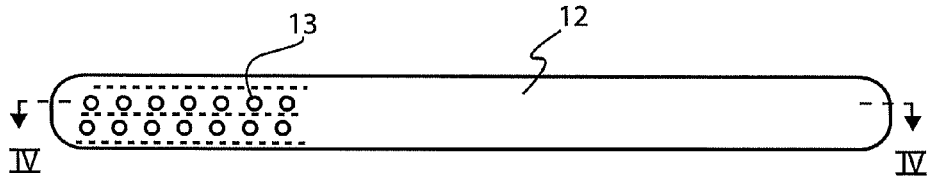
FIG. 3 is top view of the handle member showing the apertures disposed therethrough.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to drawing FIGS. 1 through 6. Illustrated therein are embodiments of a single use disposable toothbrush, generally designated 10. The disposable toothbrush 10 includes a handle member 12 produced from a pre-selected biodegradable material. The handle member 12 has each of a predetermined size and a predetermined shape.

Such pre-selected biodegradable material is preferably selected from the group consisting of wood, cardboard and plastic. Most preferably such pre-selected biodegradable material is wood. Additionally, in the presently preferred embodiment of the invention the predetermined shape of the handle member 12 is generally rectangular. Furthermore, the presently preferred predetermined size of the handle member 12 is generally between about 3.0 to about 4.0 inches long and about 0.2 to about 0.3 inch in height. Most preferably the predetermined height of the handle member 12 is about 0.25 inch.

The disposable toothbrush further includes a predetermined number of rows of bristles 14 attached to and extending above the top surface 16 of the handle member 12 closely adjacent one end thereof. The bristles 14 have a predetermined length. Preferably, the bristles 14 will extend about handle member 12 for about 0.25 inch. Additionally, in the presently preferred embodiment of the invention the predetermined number of rows of bristles 14 is five. Further, in this embodiment bristles 14 will extend above the top surface 16 of the handle member 12 for between about 0.2 and about 0.3 inch. Preferably, about 0.25 inch. The predetermined number of rows of bristles 14 preferably will have alternating rows of bristles with different heights. There are a plurality of apertures 13 formed through such one end of the handle member 12 intermediate the row of bristles 14.

The disposable toothbrush 10 includes a pouch 18 containing toothpaste therein. Pouch 18 is disposed on a radially opposed second side of the handle member 12 and over such apertures 13. Such toothpaste will be in fluid communication with the bristles 14 when the pouch 18 is punctured and compressed. There is also a means, generally designated 20, intermediate such pouch 18 and such apertures 13 for puncturing the pouch 18 when such pouch 18 is compressed.

Figure 4:
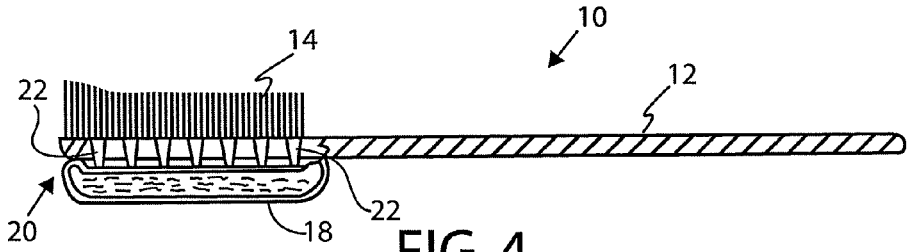
FIG. 4 is a side view of the apparatus showing the bristles and pouch containing toothpaste and the means for puncturing the pouch.

As seen in FIG. 4, such means 20 includes a plurality of protrusions 22 that are disposed intermediate such second side of such handle member 12 and such pouch 18 for puncturing the pouch 18 thereby releasing such toothpaste when such pouch 18 is compressed against such plurality of protrusions.

Figure 7:
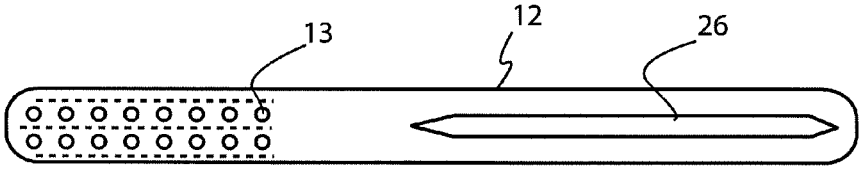
FIG. 7 is a top view of the invention showing the apertures and a toothpick disposed on a first side of the handle member for use in puncturing such pouch member.

In a second embodiment of the invention, as seen in FIG. 7, there is provided a single use disposable toothbrush 10. Such single use disposable toothbrush 10 comprises a handle member 12 produced from a pre-selected biodegradable material, such handle member 12 has a predetermined size and a predetermined shape. A predetermined number of rows of bristles 14 are attached to and extend from a first surface of the handle member 12 closely adjacent one end thereof, such bristles 14 having a predetermined length. A plurality of apertures 13 are formed through such one end of such handle member 12 and intermediate the rows of bristles 14. A pouch 18, containing toothpaste, is disposed on a radially opposed second side of the handle member 12 and over the apertures 13, such toothpaste being in fluid communication with the bristles 14 when the pouch 18 is punctured and compressed. There is, further, a means disposed on the handle member 12 pouch 18 for puncturing such pouch thereby permitting the toothpaste to flow onto the bristles 14 when the pouch 18 is compressed.

Such means for puncturing the pouch includes a toothpick 26 that is releasably engageable with such first side of the handle member 12 for use in puncturing the pouch 18. The toothpick 26 is removed from the handle 12 and pushed through the apertures 13 contacting and puncturing the pouch 18 disposed therebelow. After puncturing the pouch 18 in several places the pouch is compressed by pushing on it to release the toothpaste to the bristles 14. Such toothpick 26 is secured to the handle member 12 with a gel like glue in which the bond is easily broken. Also the gel like glue is easily removed from the toothpick 26 or from the handle member 12 whenever the toothpick 26 is removed.

Figure 5:
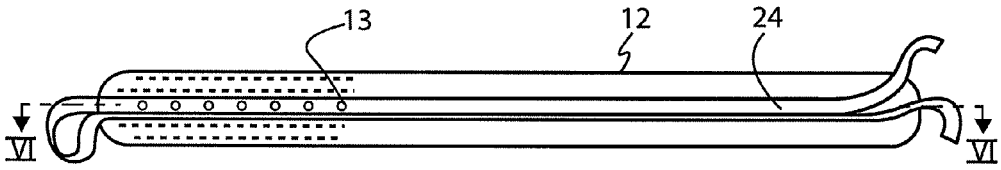
FIG. 5 is a top view of the handle member showing a row of apertures covered with dental floss according to an alternate embodiment of the invention.
Figure 6:
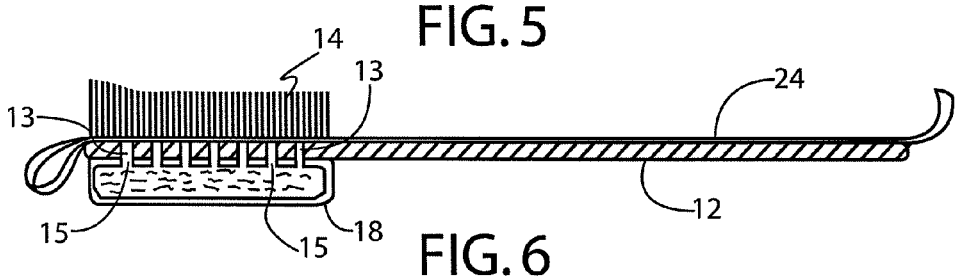
FIG. 6 is a cross sectional view of the embodiment shown in FIG. 5 showing the pouch having apertures disposed therein that correspond to the apertures in the handle member.

In a third embodiment of the invention, as seen in FIGS. 5 and 6, there is provided a single use disposable toothbrush 10, such single use disposable toothbrush comprises a handle member 12 produced from a pre-selected biodegradable material, such handle 12 having a predetermined size and a predetermined shape. A predetermined number of rows of bristles 14 are attached to and extend from a first surface of the handle member 12 closely adjacent one end thereof, such bristles 14 having a predetermined length. There are a plurality of apertures 13 formed through such one end of the handle member 12 and intermediate the rows of bristles 14, such plurality of apertures 13 being disposed in a single row substantially in a center of such one end of the handle member 12. A pouch 18, containing toothpaste, is disposed on a radially opposed second side of the handle member 12 and over such apertures 13, the pouch includes a plurality of apertures 15, such apertures are in fluid communication with corresponding apertures 13 disposed on the one end of such handle member 12. There is also a means removably engageable with the handle member 12 for covering such apertures 13 on the one end of the handle member 12 so as to prevent such toothpaste from flowing until such means is removed thereby permitting such toothpaste to flow onto the bristles 14 when such pouch 18 is compressed.

These apertures 15 correspond to the apertures 13 disposed on the one end of the handle member 12. The apertures 13 on the handle 12 are covered with a strip of dental floss 24 to prevent the toothpaste disposed in the pouch 18 from leaking out of the pouch 18. When the strip of dental floss 24 is removed and the pouch 18 is compressed the toothpaste is free to flow to the bristles 14. Such dental floss after it has been removed from the handle can be used to floss the teeth after brushing.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A single use disposable toothbrush, said single use disposable toothbrush comprising:

(a) a handle member produced from a pre-selected biodegradable material, said handle member having a predetermined size and a predetermined shape;

(b) a predetermined number of rows of bristles attached to and extending from a first surface of said handle member closely adjacent one end thereof;

(c) a plurality of apertures formed through said one end of said handle member and intermediate said rows of bristles, said plurality of apertures being disposed in a single row substantially in a center of said one end of said handle member;

(d) a pouch, containing toothpaste, disposed on a radially opposed second side of said handle member and over said apertures, said pouch includes a plurality of apertures, said apertures in communication with corresponding apertures disposed on said one end of said handle member; and (e) a strip of dental floss removably engageable with said handle member for covering said apertures on said one end of said handle member so as to prevent such toothpaste from flowing until said strip of dental floss is removed thereby permitting said toothpaste to flow onto said bristles when said pouch is compressed.

2. A disposable toothbrush, according to claim 1, wherein said pre-selected biodegradable material is selected from the group consisting of wood, cardboard and plastic.

3. A disposable toothbrush, according to claim 2, wherein said pre-selected biodegradable material is wood.

4. A disposable toothbrush, according to claim 2, wherein said predetermined size of said handle member is generally between about 3.0 to about 4.0 inches long and between about 0.25 to about 0.38 inch wide and about 0.2 to about 0.3 inch in height.

5. A disposable toothbrush, according to claim 4, wherein said height of said handle member is about 0.25 inch in height.

6. A disposable toothbrush, according to claim 5, wherein said bristles extend above said handle member for about 0.2 and about 0.3 inch.

7. A disposable toothbrush, according to claim 6, wherein said bristles extend above said handle member for about 0.25 inch.

8. A disposable toothbrush, according to claim 2, wherein said predetermined number of rows of bristles is five rows.

9. A disposable toothbrush, according to claim 8, wherein alternating rows of bristles have different predetermined lengths.

10. A disposable toothbrush, according to claim 1, wherein said predetermined shape of said handle member is generally rectangular.

11. The apparatus, according to claim 1, wherein said dental floss can be used for flossing a user's teeth after such teeth are brushed.

12. A single use disposable toothbrush, said single use disposable toothbrush comprising:

(a) a handle member, said handle member having a predetermined size and a predetermined shape;

(b) a predetermined number of rows of bristles attached to and extending from a first surface of said handle member closely adjacent one end thereof:

(c) a plurality of apertures formed through said one end of said handle member and intermediate said rows of bristles, said plurality of apertures being disposed in a single row substantially in a center of said one end of said handle member;

(d) a pouch, containing toothpaste, disposed on a radially opposed second side of said handle member and over said apertures, said pouch includes a plurality of apertures, said apertures in communication with corresponding apertures disposed on said one end of said handle member; and (e) a strip of dental floss removably engageable with said handle member for covering said apertures on said one end of said handle member so as to prevent such toothpaste from flowing until said strip of dental floss is removed thereby permitting said toothpaste to flow onto said bristles when said pouch is compressed.

* * * * *